US005974959A

United States Patent [19]

Johnson et al.

[11] Patent Number: 5,974,959

[45] Date of Patent: Nov. 2, 1999

[54] PROCESS OF EXTRACTING OIL FROM A SEED SAMPLE

[75] Inventors: David L. Johnson; Bruce E. Cadwell, both of Johnston, Iowa

[73] Assignee: Pioneer Hi-Bred International, Inc., Johnston, Iowa

[21] Appl. No.: 09/123,600

[22] Filed: Jul. 28, 1998

Related U.S. Application Data

[62] Division of application No. 08/782,984, Jan. 14, 1997.

[51] Int. Cl.[6] ..... B30B 9/04

[52] U.S. Cl. ..... 100/37; 100/125

[58] Field of Search ..... 100/50, 53, 99, 100/110, 125, 126, 131, 132, 229 R, 240, 241, 245–248, 269.15, 269.21, 295, 915, 37

[56] References Cited

U.S. PATENT DOCUMENTS

| | | | |
|---|---|---|---|
| 127,427 | 6/1872 | Potter | 100/247 |
| 626,727 | 6/1899 | Shepard | 100/125 |
| 697,251 | 4/1902 | Hubbell | 100/248 |
| 755,126 | 3/1904 | Furst | 100/247 |
| 1,538,210 | 5/1925 | Offenhauser | 100/248 |
| 1,598,818 | 9/1926 | Happensack | 100/248 |
| 1,926,504 | 9/1933 | Njzn | 100/37 |
| 2,157,539 | 5/1939 | Holstein | 100/248 |
| 4,095,459 | 6/1978 | Feldt | 100/110 |

FOREIGN PATENT DOCUMENTS

| | | | |
|---|---|---|---|
| 534958 | 4/1922 | France | 100/125 |
| 46-17557 | 5/1971 | Japan | 100/126 |
| 5659 | 4/1921 | Netherlands | 100/240 |
| 1566287 | 5/1990 | Russian Federation | 100/99 |
| 12398 | 11/1911 | United Kingdom | 100/126 |

OTHER PUBLICATIONS

Ron Lyseng, "Oilseed Crusher on your Own Farm?", pp. 1&4, Grain News, vol. 22, No. 2, Feb. 6, 1996.

*Primary Examiner*—Stephen F. Gerrity
*Attorney, Agent, or Firm*—Zarley, McKee, Thomte, Voorhees & Sease

[57] ABSTRACT

An oilseed press of the present invention is adapted to extract oil from oilseeds. The oilseed press includes a base plate having a raised surface with straight and tapered edges. A cylindrical sleeve also has a tapered edge at one end and is adapted to slide over the raised portion of the base plate forming a tight fit between the tapered portions and forming a gap between the straight edge and the sleeve. A plunger is adapted to slide within the sleeve. By applying pressure to the plunger the oilseeds are crushed between the plunger and the raised surface of the base plate. Oil collects within the gap and exits the gap through a notch formed in the tapered surface where it collects in a well. The pressure is applied by a linear actuator having a rubber bumper assembly. When the clutch of the linear actuator begins to slip, the bumper assembly maintains a high pressure on the plunger.

6 Claims, 7 Drawing Sheets

PROCESS OF EXTRACTING OIL FROM A SEED SAMPLE

This is a divisional of copending application(s) Ser. No. 08/782,984 filed on Jan. 14, 1997.

BACKGROUND OF THE INVENTION

1. Field of the Invention

The present invention relates to the oilseed industry. More particularly, though not exclusively, the present invention relates to an apparatus and method for extracting oil from oilseeds.

2. Problems in the Art

In the oilseed industry, it is desirable to analyze oil extracted from seeds such as sunflower seeds or canola seeds. In order to continually improve the quality of oilseed crops as well as evaluating harvested oilseeds, it is helpful to know certain properties of the oilseed such as oleic levels, oil content of the seeds, etc. These measurements are typically performed by obtaining a sample of the oilseed oil and using a device such as a refractometer to show the oleic level, for example.

In order to separate oil from an oilseed, the seed must be crushed or the oil separated chemically. A typical prior art device for extracting oil from oilseeds is comprised of a pair of iron plates and a hydraulic jack for pressing the iron plates together. The resulting oil extracted from this prior art method is spread over a very large area of the iron plates and is also mixed among the crushed seeds. To get a suitable oil sample, the iron plates must be scraped with a squeegee and the crushed seeds separated from the oil. As a result, it is very difficult, time consuming and messy to obtain a suitable oil sample using the prior art method. Another prior art method of extracting seeds from an oilseed is to place a seed in the jaws of a vice grip and crush the seed. This also has obvious undesirable results. Another problem with the prior art methods of extracting oil from oilseeds is that each resulting sample of oil is small and comes from just a few seeds. It would be desirable to have an oil sample coming from a large number of seeds to get a more accurate indication of the properties of the seeds which may have variations from one seed to another.

Oilseed extractors also exist in the art for use on a commercial scale. This type of equipment is very expensive and not practical for obtaining just a sample of oil.

Other prior art devices to extract seeds from oilseeds are comprised of a perforated tube with a screw type bit fitting in the interior of the tube. The screw bit presses seeds through the perforated tube with the oil coming out the sides. These types of devices are very difficult and time consuming to clean between samples and are also very expensive.

Therefore, a need can be seen for an improved system and method for extracting oil from oilseeds.

FEATURES OF THE INVENTION

A general feature of the present invention is the provision of a method and apparatus for extracting oil from oilseeds which overcomes problems found in the prior art.

A further feature of the present invention is the provision of a method and apparatus for extracting oil from oilseeds which uses a die assembly for crushing the oilseeds and collecting the oil in a well.

A further feature of the present invention is the provision of a method and apparatus for extracting oil from oilseeds which collects the oil in a well by providing a path for the oil to travel when the seeds are crushed.

Further features, objects and advantages of the present invention include:

An apparatus and method for extracting oil from oilseeds which uses a linear actuator to crush the oilseeds.

An apparatus and method for extracting oil from oilseeds which uses a die, a sleeve fitting over the die and a plunger for containing and crushing the seeds.

An apparatus and method for extracting oil from oilseeds which uses a die and a sleeve fitted over the die and includes a notch in the die for allowing oil to exit the area within the sleeve.

An apparatus and method for extracting oil from oilseeds which includes a well for collecting the extracted oil as well as a means for easily removing the oil from the well.

An apparatus and method for extracting oil from oilseeds which uses a linear actuator having a rubber pad between the actuator and the plunger for maintaining a high pressure when the clutch of the linear actuator slips.

An apparatus and method for extracting oil from oilseeds which includes a die having a raised surface with a skirt formed around the periphery of the surface and a sleeve which fits around the skirt.

An apparatus and method for extracting oil from oilseeds which includes a die having a raised surface and a skirt formed around the raised surface as well as a notch formed in the skirt for allowing extracted oil to flow through the notch.

An apparatus and method for extracting oil from oilseeds which includes various safety features.

These as well as other objects, features and advantages of the present invention will become apparent from the following specification and claims.

SUMMARY OF THE INVENTION

The oilseed press of the present invention is used to extract oil from oilseeds such as sunflower seeds or canola seeds. The invention is comprised of a base plate having a raised surface and a round sleeve adapted to fit over the raised surface. The seeds are placed within the round sleeve and a plunger is inserted into the sleeve over the seeds. By applying a force to the plunger, oil from the oilseeds will exit via a notch formed in the raised surface.

The present invention may optionally include a linear actuator to apply a force to the plunger. The invention may also include a bumper assembly disposed between the linear actuator and the plunger to maintain a high pressure when the clutch of the linear actuator slips.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
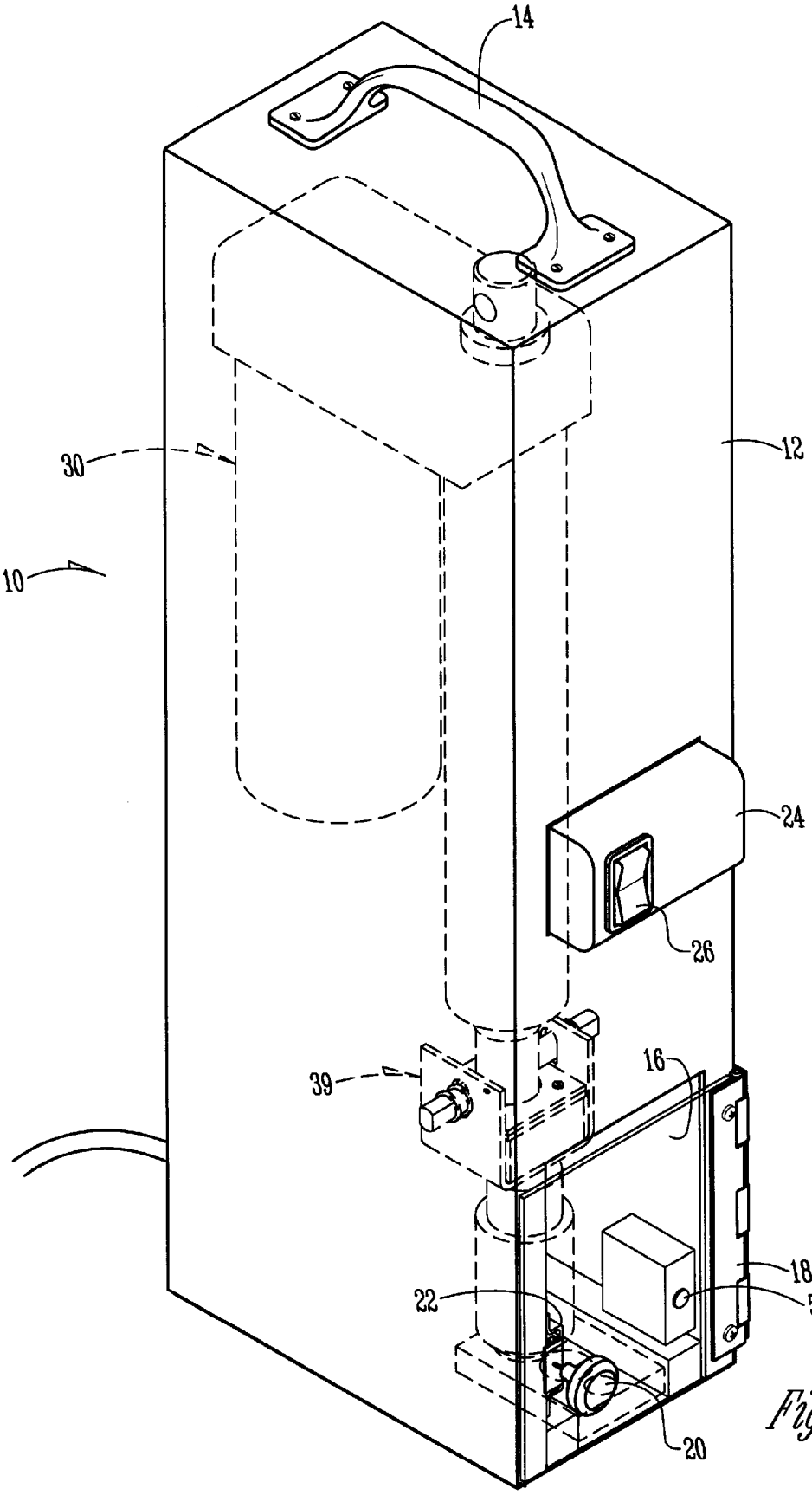
FIG. 1 is a prospective view of an oilseed press of the present invention.

FIG. 1 shows an oilseed press 10 of the present invention. The oilseed press 10 is enclosed by a housing 12 having a handle 14 and a PLEXIGLAS™ (acrylic plastic sheet) door 16. The PLEXIGLAS™ (acrylic plastic sheet) door 16 is attached to the housing by a hinge 18 and can be opened and closed by use of a handle 20. The door is held shut by a magnetic latch 22. A switch box 24 is attached to the housing and houses a snap-in rocker switch 26 for controlling the operation of the oilseed press 10. The location of the switch box 24 is shown to be above the door 16, although the location is not critical to the invention.

Figure 2:
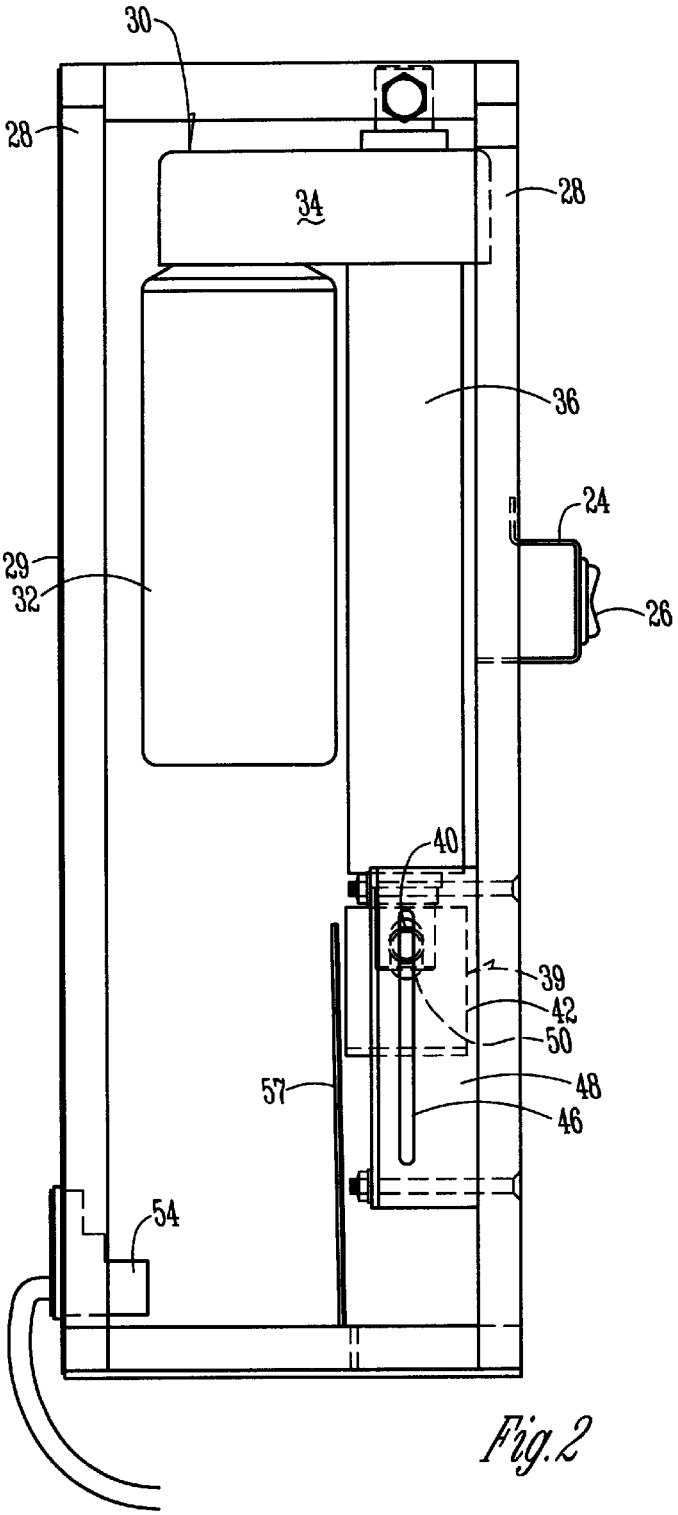
FIG. 2 is a side view of the oilseed press shown in FIG. 1.
Figure 3:
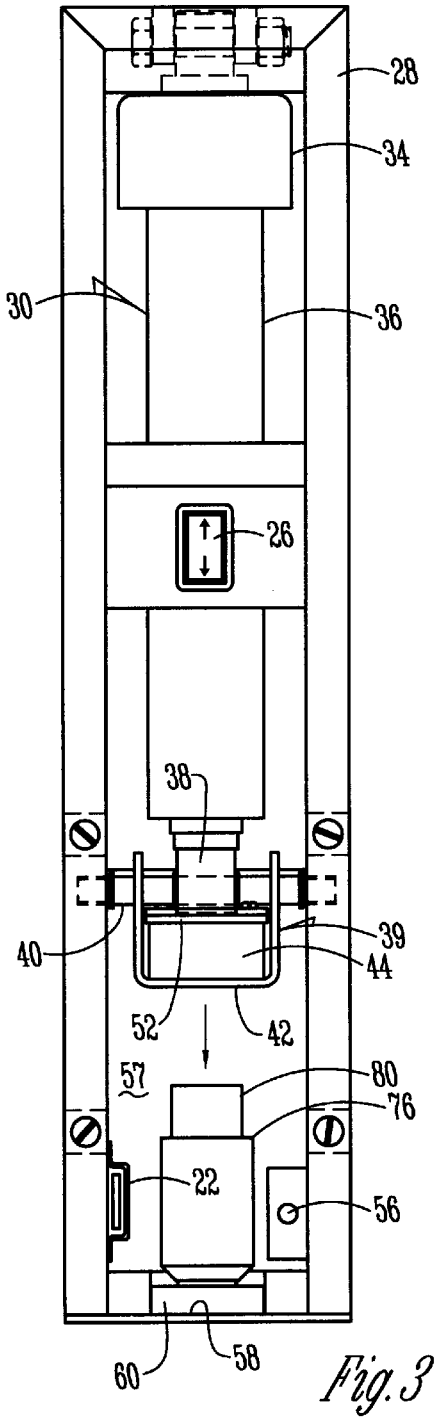
FIG. 3 is a front view of the oilseed press shown in FIG. 1.

FIGS. 2 and 3 show side and front views of the oilseed press 10 with the housing 12 removed. As shown in FIG. 2, within the housing 12 is a frame 28 which holds all the components of the invention. Attached to the frame 28 at the back of the press 10 is a backplate 29 comprised of a flat sheet of metal. Coupled to the frame 28 is a linear actuator 30 which is used to create a high pressure force for crushing the oilseeds (described below). The linear actuator 30 is comprised of an electric motor 32, a gear box 34, and an actuator 36. The linear actuator is preferably powered by a 115 or 230 VAC source. As shown in FIG. 3, the actuator 36 includes a rod 38 which moves up and down in response to the activation of the rocker switch 26.

Coupled to the rod 38 is an actuator bumper assembly 39 comprised of a shaft 40, a U-bracket 42 and a rubber bumper 44. The shaft 40 has ends which are machined flat and inserted into a slot 46 formed in a guide member 48. The guide member 48 is coupled to the frame 28. The combination of the slot 46 and the shaft 40 insures that the rod 38 moves up and down in a straight and uniform manner. Also attached to the rod 38 is a U-bracket 42. The U-bracket 42 includes a slot 50 which is formed around the shaft 40. This allows the U-bracket 42 to move slightly up and down relative to the shaft 40 and rod 38. Fitted between the U-bracket 42 and the rod 38 is a rubber bumper 44 and a bumper plate 52. The rubber bumper 44 is comprised of a square-shaped piece of rubber, preferably comprised of SBR rubber. The purpose of the actuator bumper assembly 39 is to maintain a high pressure during the operation of the oilseed press. The linear actuator 30 includes a clutch (not shown) which causes the rod 38 to stop moving in either direction once a certain resistance is met. At the time when the clutch starts slipping, the force applied by the rod 38 will fluctuate and reduce significantly. However, this is avoided by the use of the actuator bumper assembly 39. When the linear actuator moves down and reaches the object to be pressed, the rubber bumper 44 will start compressing before the clutch starts slipping. Once the clutch does start slipping, the rubber bumper 44 will maintain the high pressure on the object being pressed.

FIGS. 1–3 also show other components of the oilseed press 10. As shown in FIG. 2, a power entry module 54 is coupled to the backplate 29 and is supplied with electrical power through a power cord. The power entry module 54 preferably includes a fuse and power switch. FIGS. 1 and 3 show a limit switch 56 which is a safety device. The limit switch 56 is electrically connected to the power entry module 54 and the linear actuator 30. The limit switch 56 will be in a closed position when the PLEXIGLAS™ (acrylic plastic sheet) door 16 is closed (FIG. 1). This prevents the linear actuator 30 from being activated while the PLEXIGLAS™ (acrylic plastic sheet) door 16 is opened, thus reducing the risk of any injury to a user. A metal plate 57 is located between the door 16 and the backplate 29 (FIG. 2). The metal plate 57 simply blocks off the space behind the door 16.

The oilseed press 10 has a channel 58 formed in the frame which is adapted to receive a die set (described below) which is used for crushing oilseeds. In this way, the die set can be removed or inserted into the oilseed press 10 by opening the door 16 and simply sliding the die set into the channel 58.

Figure 4:
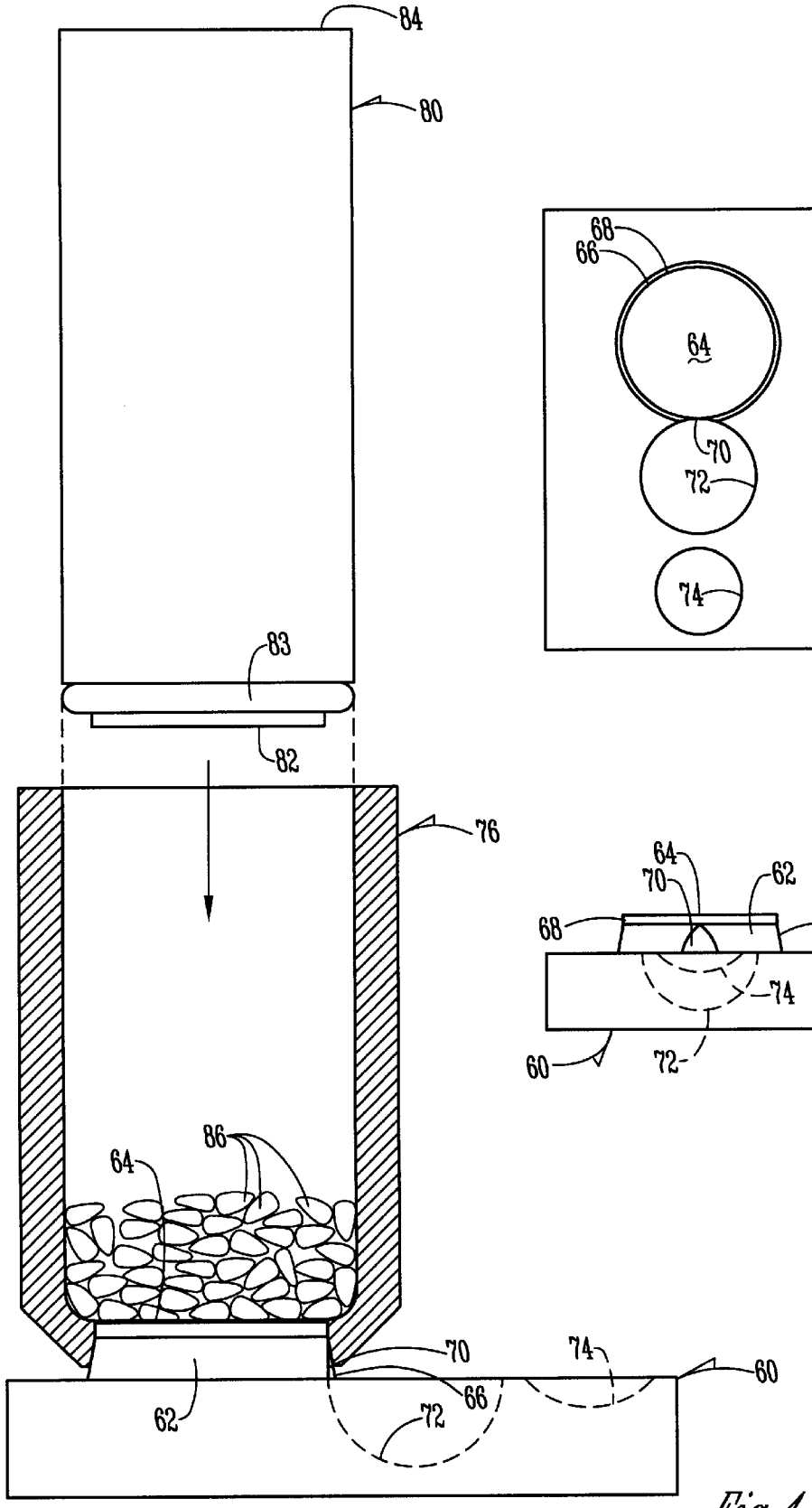
FIG. 4 is a side view of the die, sleeve, and plunger of the present invention.
Figure 7:
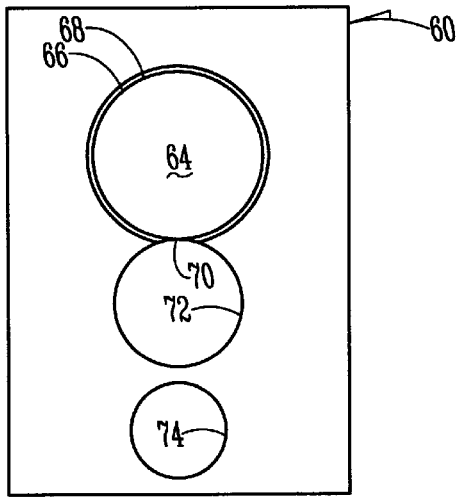
FIG. 7 is a top view of the die shown in FIG. 4.
Figure 8:
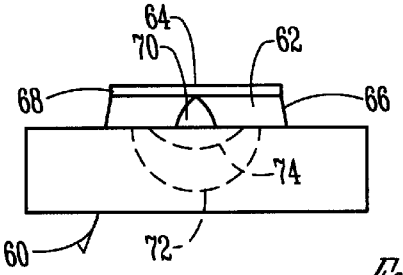
FIG. 8 is a front view of the die shown in FIG. 4.

FIGS. 4–8 show various pictures of the components of the die set. As shown in FIGS. 4 and 8, a base plate 60 is rectangular in shape and includes a raised portion 62 having an upward facing upper surface 64. As shown in the figures, the raised portion 62 has a tapered edge 66 encircling the raised portion 62 forming a skirt. Above the tapered edge 66 is a straight edge 68. A notch 70 is formed in the skirt 66 and provides a path for oil to flow (discussed below). The base plate 60 also includes a well 72 which collects the extracted oil (discussed below). The base plate 60 also includes an indentation 74 which simply allows the base plate 60 to be easily handled by a user.

Figure 6:
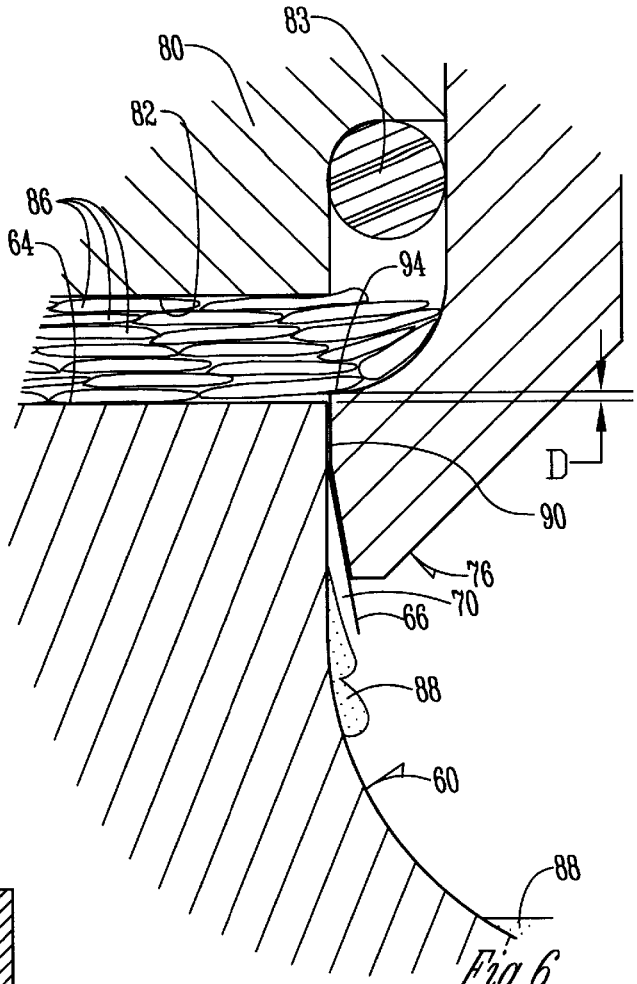
FIG. 6 is an enlarged view taken along line 6—6 of FIG. 5.
Figure 5:
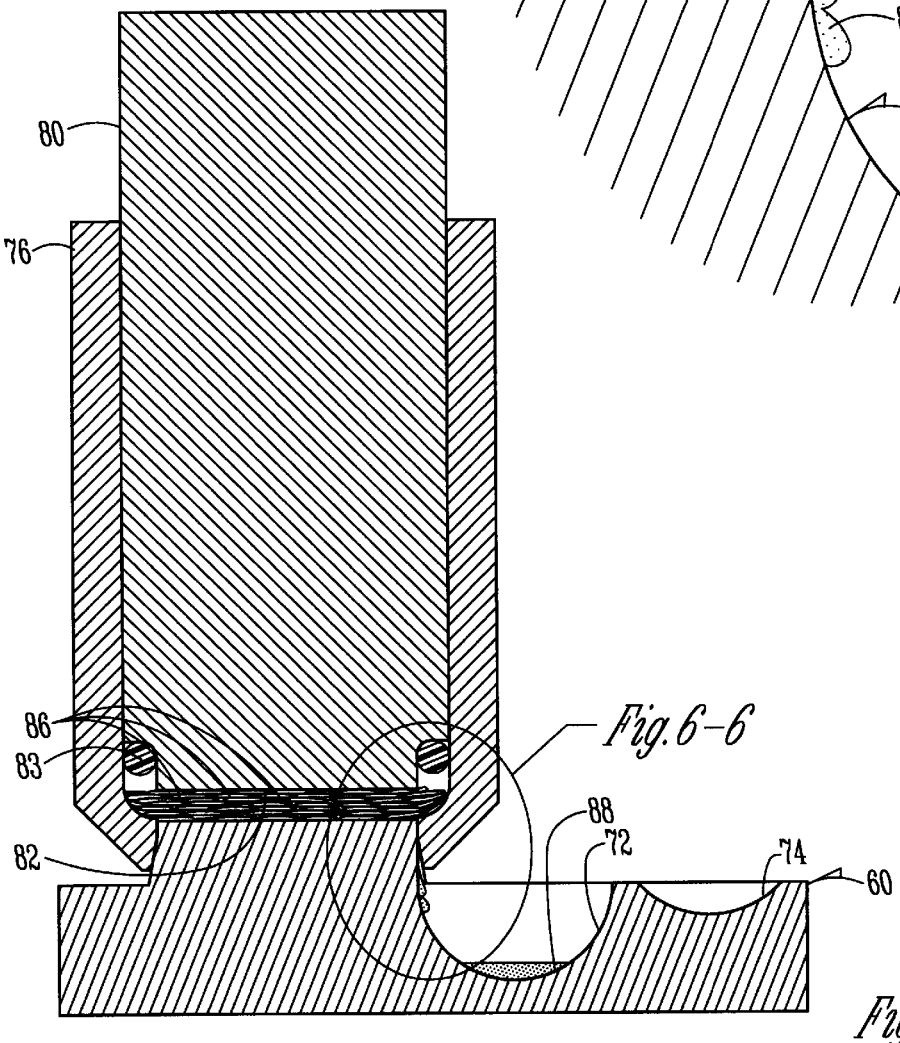
FIG. 5 is a sectional side view of the die, sleeve, and plunger of the present invention.

A cylindrically-shaped sleeve 76 having open ends is shaped to fit over the raised portion 62 of the base plate 60. The sleeve 76 has a shape which generally matches the skirt 66 and the straight edge 68 of the raised portion 62. During use, the sleeve 76 is inserted over the base plate 60 as shown in FIGS. 4–6. The combination of the sleeve 76 and base plate 60 is adapted to receive a plurality of oilseeds, such as sunflower seeds. A cylindrical plunger 80 has a size matingly similar to the inside diameter of the sleeve 76 and is adapted to slide within the sleeve 76. The plunger 80 includes a flat lower surface 82 which crushes the oilseeds (described below). The plunger 80 also includes a rubber O-ring 83 which provides a better seal between the plunger 80 and the sleeve 76. The opposite end of the plunger 80 has an upper surface 84 which makes contact with the U-bracket when the linear actuator 30 is activated.

FIG. 4 shows a plurality of sunflower seeds 86 before they are crushed to extract their oil. By pressing the rocker switch 26 to the down position, the linear actuator presses the plunger 80 downward crushing the seeds 86 between the lower surface 82 and the upper surface 64 of the base plate. FIG. 5 is a cross sectional view showing the seeds 86 after they are crushed. By crushing the seeds, oil 88 from the seeds exits the chamber formed by the base plate 60 and sleeve 76 through the notch 70 and into the well 72. FIG. 6 is an enlarged view showing more clearly how the oil 88 is guided into the well 72. As shown in FIG. 6, there is a small gap 90 between the sleeve 76 and the straight edge 68 of the base plate 60. Note that the fit between the skirt 66 and the sleeve 76 is a much tighter fit which prevents oil from seeping between the skirt 66 and sleeve 76. The gap 90 allows the extracted oil 88 to collect in the gap 90 where it drains into the well 72 through the notch 70. To further assist in the extraction of oil, there is a difference in height D between the upper surface 64 of the base plate 60 and the corresponding surface 94 of the sleeve 76. Without this difference D, it is possible that some of the seeds 86 would be positioned over the top of the gap 90 preventing oil from entering the gap 90. With the difference D present, the seeds 86 will more likely maintain the position shown in FIG. 6 which allows oil 88 to flow into the gap 90. Preferably the difference in height D is 0.030 inches, although this could vary.

While the size of the base plate 60 and sleeve 76 could vary, the preferred dimensions are as follows. The base plate 60 has a total height of 0.75 inches with 0.25 inches of the height coming from the raised portion 62. The straight edge 68 has a diameter of 0.997 inches and a height of 0.0625 inches. The tapered edge 66 has a taper of 10.0°. The inside diameter of the sleeve 76 which, with the straight edge 68, forms the gap 90, is 1.00 inches which results in a gap of 0.0015 inches. The notch 70 has a depth such that the innermost surface of the notch 70 is straight down from the straight edge 68 (FIG. 6). The sleeve 76 is 2.5 inches long with an outside diameter of 1.625 inches.

Figure 10:
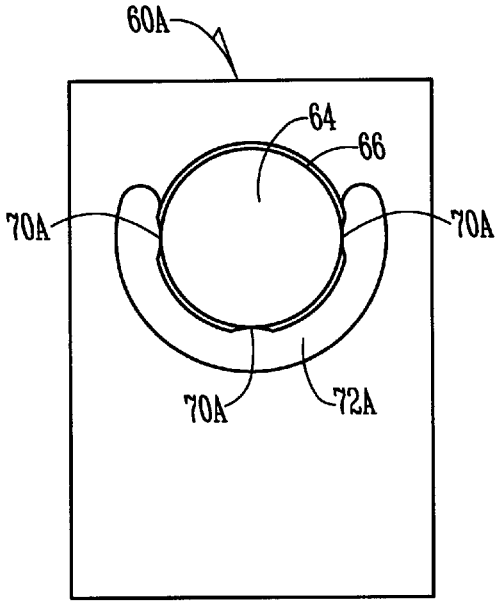
FIGS. 10–12 show alternative embodiments of the die of the present invention.
Figure 11:
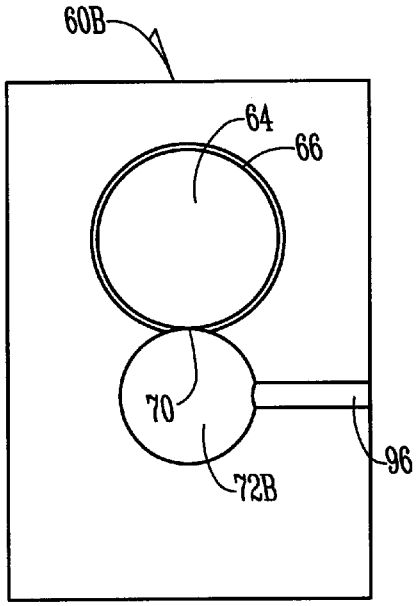
Figure 12:
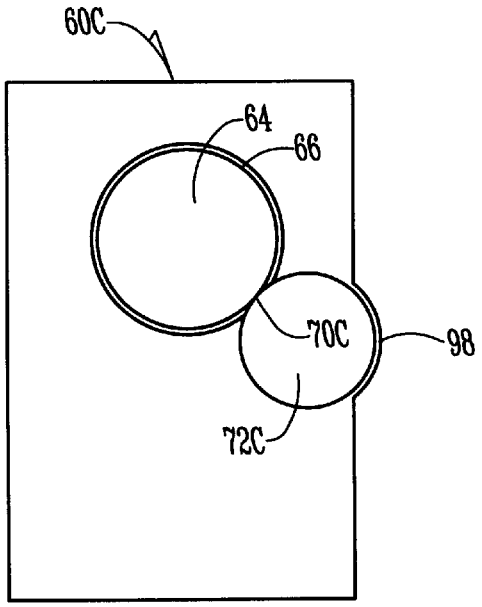

FIG. 7 shows a top view of the base plate 60 of the preferred embodiment. While FIG. 7 shows the preferred embodiment for the base plate 60, other embodiments are also possible, for example as shown in FIGS. 10–12. FIG. 10 shows a base plate 60A having the same upper surface 64 and skirt 66 as base plate 60. However, the base plate 60A has a U-shaped well 72A and three notches 70A formed in the skirt 66. Using the base plate 60A, oil is allowed to exit a chamber formed by the sleeve 76 and upper surface 64 through three different paths formed by the notches 70A. FIG. 11 shows a base plate 60B having an upper surface 64, skirt 66, and notch 70 like the base plate 60 in FIG. 7 but has a modified well 72B. The well 72B is in communication with a channel 96 which extends from the well 72B to the edge of the base plate 60B. Channel 96 allows the user to pour out the oil which collects in the well 72B. FIG. 12 shows a base plate 60C which includes an upper surface 64, skirt 66, and a notch 70C formed off center of the base plate 60C. A well 72C is formed in the base plate 60C and partially extends from the edge of the base plate 60C forming a lip 98 which makes the oil easier to pour from the base plate 60C.

Figure 9:
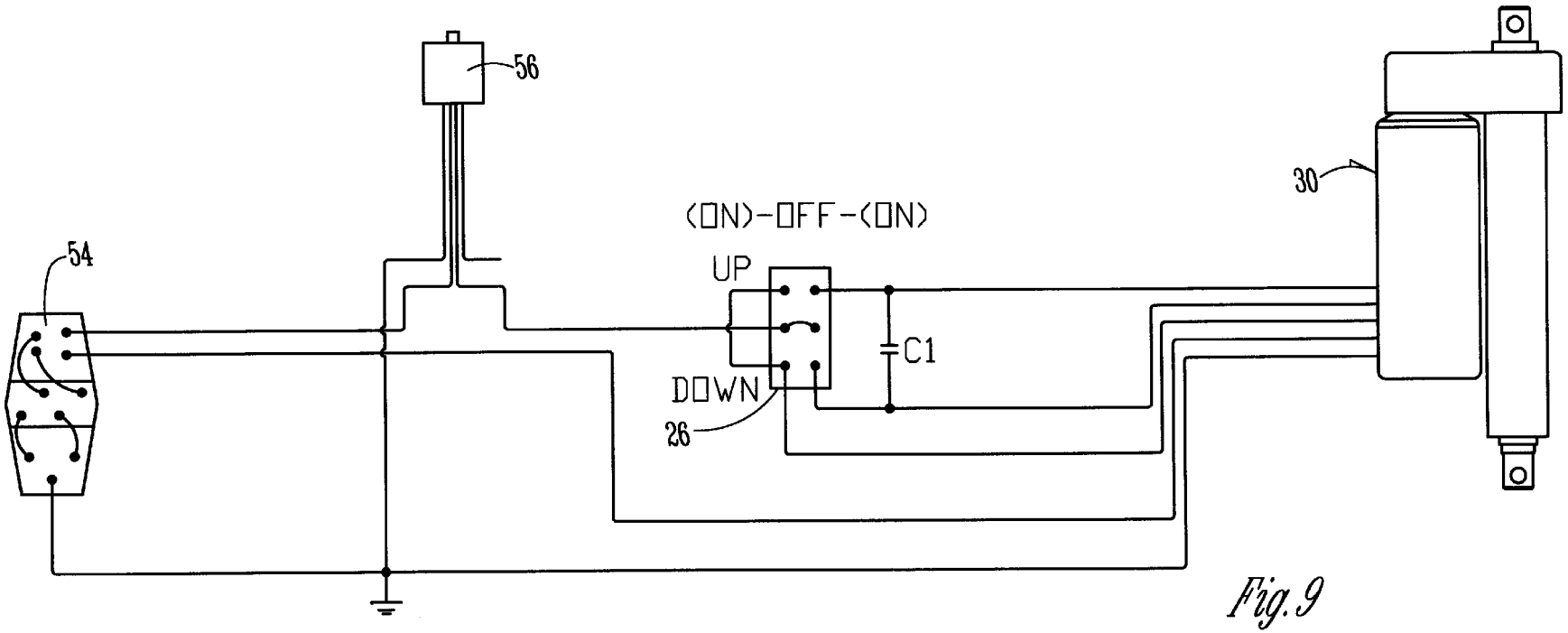
FIG. 9 is an electrical diagram of the oilseed press shown in FIG. 1.

FIG. 9 is an electrical schematic diagram showing how the oilseed press 10 shown in the figures is electrically wired. FIG. 9 shows the linear actuator 30, the rocker switch 26, the limit switch 56, the power entry module 54, and the wiring of these components. Table 1 at the end of this description illustrates the preferred components of the present invention.

Figure 13:
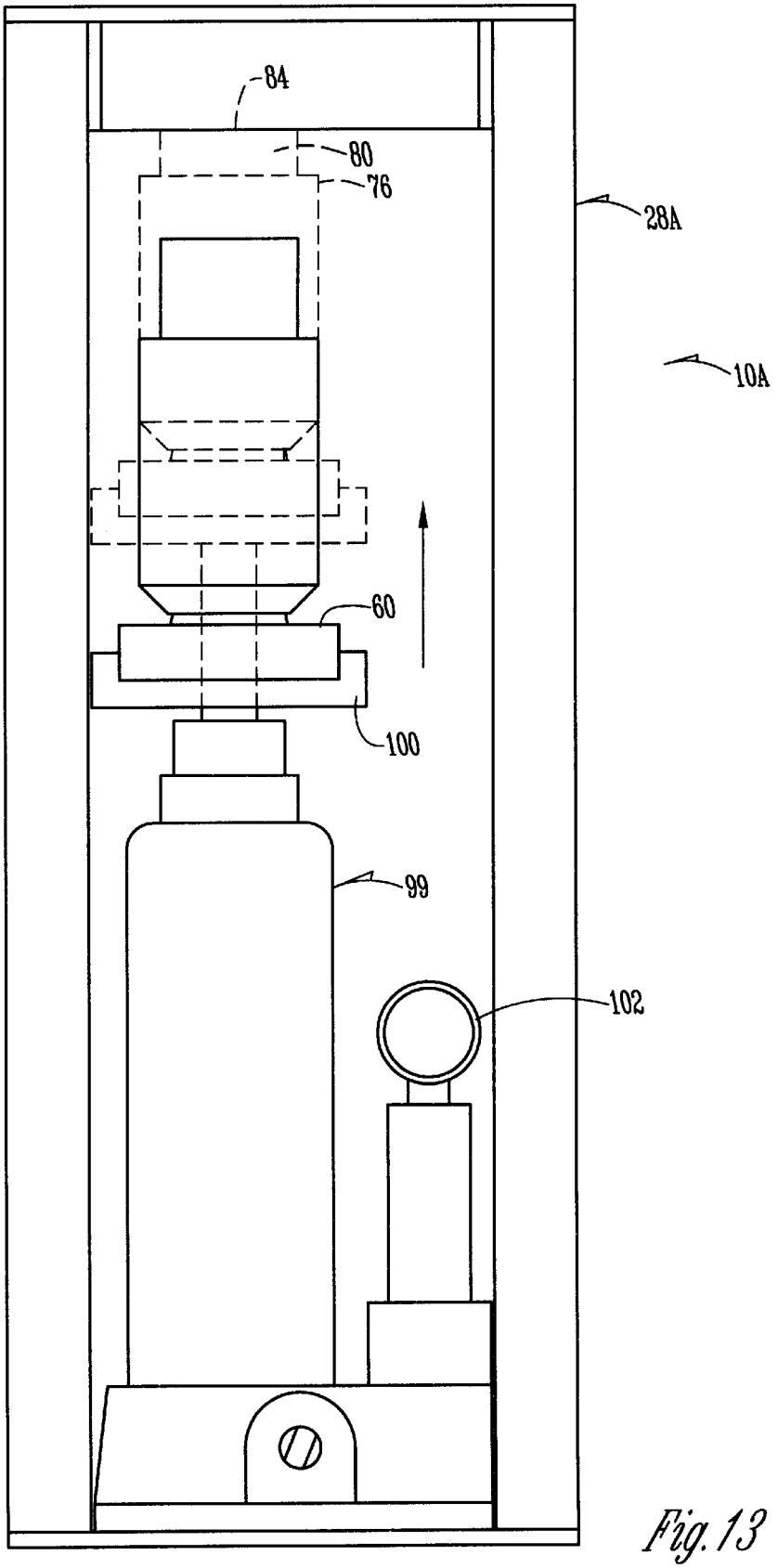
FIG. 13 shows a manual oilseed press of the present invention.

FIG. 13 shows an alternative oilseed press 10A which is generally the same as the oilseed press 10 shown in FIG. 1, but replaces the linear actuator 30 with a hand jack 99. The oilseed press 10A includes a frame 28A and a jack 99 which is mounted within the frame 28A. Attached to the jack 99 is a tray 100 which is adapted to receive the base plate 60 much like the channel 58 described above. To operate the oilseed press 10*a*, the die set is set on the tray 100 with the jack in a lowered position (shown by solid lines). A jack handle (not shown) is inserted into the hole 102 so that the jack can be manually raised. Raising the jack 99 moves the tray 100 up towards the top of the frame 28*a*. When the upper surface 84 of the plunger 80 contacts the frame 28*a*, the plunger 80 begins to crush the seeds (this position is shown by dashed lines). The oilseed press 10A can be used in the field where no power is available or where a lower costing oilseed press is desired.

The present invention operates as follows. Typically, the oilseed press 10 of the present invention is used either during or after the harvesting of oilseeds such as sunflower seeds or canola seeds. The user of the oilseed press 10 will periodically take samples of the seeds and extract oil so that the oil can be evaluated or tested. To extract the oil, the user will place the sleeve 76 on the base plate 60 and will place a number of seeds 86 (preferably about 200 seeds) into the sleeve 76 (FIG. 4). The plunger 80 is then inserted into the sleeve 76 over the seeds 86. The user then closes the PLEXIGLAS door 16 (FIG. 1) and presses the rocker switch 26 to the down position. When the switch 26 is pressed down, the linear actuator 30 will begin moving the rod 38 and actuator bumper assembly 39 downward toward the plunger 80 (FIG. 3). As the actuator bumper assembly moves downward, the seeds 86 become crushed (FIG. 5). When the plunger 80 reaches a position where it no longer will go any further, such as shown in FIG. 5, the rubber bumper 44 will begin to compress and deform. At that point, the clutch (not shown) of the linear actuator 30 will start slipping and the user will know that the maximum amount of pressure has been applied. Even though the clutch starts slipping, the actuator bumper assembly 39 maintains a high amount of pressure on the plunger 80. When the oilseeds 86 are crushed (FIGS. 5 and 6), oil 88 from the crushed seeds 86 will flow into the gap 90 between the sleeve 76 and the straight edge 68 of the base plate 60. Once the oil is within the gap 90, it has no place to flow except through the notch 70 to the well 72. As a result, the well 72 will contain a sufficient sample of oil 88 for testing and evaluation purposes. To remove the die set from the oilseed press 10, the rocker switch 26 is pressed upward, which raises the rod 38 and actuator bumper assembly 39. The door 16 can then be opened and the base plate 60 removed by grasping the indentation 74. Another sample of seeds can then immediately be processed by use of a second die set or by simply wiping the first die set clean and placing more seeds within the sleeve 76.

The invention could take on many alternate forms or dimensions within the scope of the invention. For example, the electrical linear actuator shown in the Figures could be replaced by a hydraulic press, etc. The oilseed press 10 could be used to extract oil from many types of seeds including sunflower seeds, canola seeds, soy beans, etc. Also, the press 10 is not limited to oil extraction. The press 10 could be used to extract almost any type of material which is found in another material.

TABLE 1

| Part Number/Manufacturer | Description |
|---|---|
| CORCOM 4EDL1S | IEC320 power entry module with 2 fuses (2.8A slow acting fuses in the 230VAC unit) (5.0A slow acting fuses in the 115VAC unit), EMI filter, & switch |
| General Electric 97F9612BX | Capacitor C1: |
| General Electric 97F5300BX | 370VAC 35 mfd capacitor (for use with the 115V actuator) 440VAC 10 mfd capacitor (for use with the 230V actuator) |
| Carling Switch TIGM5M-6S-BL-NBL/MATTE | (on)-off-(on) momentary rocker switch, DPDT |
| Telemanique MS01S01-21 | limit switch |
| Warner A12-10B5-04D | 1000 lb. 4" travel linear |
| Warner A22-10B5-04D | 1000 lb. 4" travel linear actuator (230V) |

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A method of extracting oil from seeds comprising the steps of:

providing an impervious first surface;

providing walls extending from the first surface forming a cavity;

forming a path from inside the cavity to the outside of the cavity, the path being formed between the walls and the first surface;

placing a plurality of seeds within the cavity;

placing a plunger having an actuator operatively connected to the plunger over the seeds within the cavity;

providing a resilient member between the actuator and the plunger; and actuating the actuator to apply a force to the plunger to crush the seeds between the plunger and the first surface forcing extracted oil from the seeds to exit the cavity through the path.

2. The method of claim 1 wherein the walls are comprised of a cylindrical tube and wherein the first surface has a rounded shape and an edge along the periphery of the first surface.

3. The method of claim 2 further comprising the step of forming a gap between the edge of the first surface and the cylindrical tube.

4. The method of claim 3 wherein the path is comprised of a notch formed in the first surface.

5. The method of claim 1 wherein the resilient material is comprised of rubber.

6. A method of extracting oil from seeds comprising the steps of:

providing a first surface;

providing walls extending from the first surface forming a cavity;

forming a path from inside the cavity to the outside of the cavity;

placing a plurality of seeds within the cavity;

placing a plunger over the seeds within the cavity; and providing an actuator operatively coupled to the plunger;

providing a resilient material between the actuator and the plunger;

actuating the actuator to apply a force to the plunger to crush the seeds between the plunger and the first surface forcing extracted oil from the seeds to exit the cavity through the path.

* * * * *